US010933512B2

(12) United States Patent
Boiteux

(10) Patent No.: US 10,933,512 B2
(45) Date of Patent: Mar. 2, 2021

(54) CLAMPING SYSTEM USING WEDGE WITH ANGLE TRANSMISSION

(71) Applicant: Christophe Boiteux, Landresse (FR)

(72) Inventor: Christophe Boiteux, Landresse (FR)

( * ) Notice: Subject to any disclaimer, the term of this patent is extended or adjusted under 35 U.S.C. 154(b) by 283 days.

(21) Appl. No.: 15/326,268

(22) PCT Filed: Jul. 17, 2015

(86) PCT No.: PCT/EP2015/066382
§ 371 (c)(1),
(2) Date: May 18, 2017

(87) PCT Pub. No.: WO2016/009034
PCT Pub. Date: Jan. 21, 2016

(65) Prior Publication Data

US 2017/0252902 A1 Sep. 7, 2017

(30) Foreign Application Priority Data

Jul. 17, 2014 (FR) ..... 14 56849

(51) Int. Cl.
*B25B 5/08* (2006.01)
*B25B 5/00* (2006.01)
*B25B 5/06* (2006.01)

(52) U.S. Cl.
CPC ..... *B25B 5/087* (2013.01); *B25B 5/006* (2013.01); *B25B 5/062* (2013.01); *B25B 5/064* (2013.01)

(58) Field of Classification Search
CPC ..... B23B 5/006; B23B 5/06; B23B 5/061; B23B 5/062; B23B 5/064; B23B 5/87;
(Continued)

(56) References Cited

U.S. PATENT DOCUMENTS 1,438,250 A * 12/1922 Lyon ..... B23Q 3/108 269/234
3,792,855 A * 2/1974 Bondie ..... B23Q 3/103 269/310

(Continued)

FOREIGN PATENT DOCUMENTS

EP 2 138 266 12/2009
EP 2 179 817 A1 4/2010

(Continued)

OTHER PUBLICATIONS

International Search Report dated Oct. 20, 2015 out of PCT priority Application PCT/EP2015/066382 (4 pages).

(Continued)

*Primary Examiner* — Brian D Keller
(74) *Attorney, Agent, or Firm* — Brinks Gilson & Lione; John C. Freeman

(57) ABSTRACT

The present invention relates to a clamping device having a mounting element with an axis of rotation X, an actuator, a support that has an opening of axis X in which opening the mounting element and the actuator are positioned. The mounting element includes a slide in which there are positioned a ring and a locking wedge which collaborate with at least one angle transmission. The support has an interior groove arranged in the opening and the ring and the locking wedge collaborate with the interior groove. The mounting element can thus easily be angularly positioned. There are preferably two angle transmissions positioned such that they are diametrically opposed.

12 Claims, 5 Drawing Sheets

(58) Field of Classification Search
CPC ..... B23B 31/42; B23B 31/40; B23Q 3/06; B23Q 3/08; B23Q 3/082
USPC ..... 269/91, 309, 310, 60, 17
See application file for complete search history.

(56) References Cited

U.S. PATENT DOCUMENTS

| | | | | |
|---|---|---|---|---|
| 8,678,362 | B1 | 3/2014 | Luthi et al. | |
| 2006/0049569 | A1* | 3/2006 | Yonezawa ..... | B23Q 1/0081 269/309 |
| 2010/0019427 | A1 | 1/2010 | Nishida | |
| 2013/0249156 | A1* | 9/2013 | Haruna ..... | B23Q 1/009 269/32 |

FOREIGN PATENT DOCUMENTS

| | | | |
|---|---|---|---|
| FR | 2863190 | | 6/2005 |
| JP | 2010-99789 | A | 5/2010 |
| WO | WO 2012/073723 | A1 | 6/2012 |

OTHER PUBLICATIONS

Written Opinion dated Oct. 20, 2015 out of PCT priority Application PCT/EP2015/066382 (5 pages).
Notice of Reason for Rejection dated Jul. 2, 2019 (20 pages including English translation) from corresponding Application Japanese Application No. 2017-522736.

* cited by examiner

CLAMPING SYSTEM USING WEDGE WITH ANGLE TRANSMISSION

This application claims priority to International Application No. PCT/EP2015/066382 filed Jul. 17, 2015 and to French Application No. 1456849 filed Jul. 17, 2014; the entire contents of each are incorporated herein by reference.

BACKGROUND

The present invention relates to a clamping system, in particular for an element such as a clamping ring for a part.

SUMMARY

The angular positioning of this type of element is difficult because, if it is screwed to a support, its angular position could vary depending on the clamping that is carried out. This is particularly critical for a clamping ring which must be precisely positioned angularly so as to be able to correctly clamp the part.

It is also possible to attach the clamping ring to the support first, then to screw the other portion underneath. However, in this case, it is necessary to gain access to the support from below. Such an example is shown in patent application FR 2863190 A1.

The same positioning problem can also appear for other mounting elements such as positioning stops or support elements.

The object of the present invention is to propose a clamping system which allows both precise angular positioning and 360° of angular positioning. The device becomes more compact.

The clamping system according to the invention comprises an X-axis mounting element, a support having an X-axis opening in which is placed the mounting element; it is characterized in that the mounting element comprises a slide in which is positioned a locking wedge which cooperates with at least one angle transmission, the support comprises an internal cavity positioned in the opening and the locking wedge cooperates with the internal cavity. The clamping mounting element is thus easily positioned angularly. There are preferably two angle transmissions positioned substantially diametrically opposite. Control by the angle transmission makes it possible to carry out attachment while having access to only one side of the opening.

In one particular embodiment, the system comprises a cylinder positioned in the opening. The cylinder can be hydraulic or pneumatic, or an electrical or electromechanical actuator.

Advantageously, the mounting element (2) and the cylinder (3) can either be mounted pivotally around the axis X or blocked in pivoting. Thus the precise positioning of the mounting element can be ensured either by controlling pivoting or by mounting in a blocked position.

According to one embodiment, the opening is a blind hole. The device can be used either when the hole is through or when it is blind.

Advantageously, the angle transmission forms an angle comprised between 5 and 45°, preferably between 15 and 30° with respect to the axis X. Thus, if the locking wedge has a displacement perpendicular to the axis X of the mounting element, the transmission thus makes it possible to block the locking wedge by a movement of the transmission parallel to the axis X. The force of this movement is amplified due to the choice of the angle, while being reversible.

Advantageously, the mounting element comprises an abutment face cooperating with a lower face of the internal cavity. The abutment face is preferably placed on the insertion side of the mounting element in the support, thus when the mounting element is positioned on the support, this is blocked along the axis X. Preferably, this abutment face cooperates with a rest positioned on the support. According to one advantageous feature, the wedge comprises an inclined upper clamping cone capable of resting against an inclined upper face of the internal cavity so as to clamp the mounting element on the abutment face. Thus the position of the mounting element in the hole is determined by resting against the abutment face. Resting against the conical surfaces also make it possible to increase contact forces, hence the clamping power.

The abutment face is advantageously a clamping cone. According to a complementary arrangement, the device comprises an elastic element housed in a circular groove and resting on the locking wedge, the elastic element tending to clamp the locking wedge against the angle transmission. Thus the dismantling of the device is easy, the retraction of the angle transmission making it possible to obtain the disengagement of the locking wedge from the groove. The elastic element is for example a snap ring. The section of the snap ring can be circular, but it could also be polygonal, square or rectangular for example.

Advantageously, the mounting element is a clamping ring.

Advantageously, the opening is circular.

Advantageously, the internal cavity is a circular internal groove.

Alternatively, the internal cavity is formed by a plurality of notches. Each of these notches is capable of receiving one of the locking wedges. This cooperation ensures angular indexing of the mounting element in the opening.

The invention also relates to a method for clamping a mounting element in a support having an opening in which is placed the mounting element comprising a slide in which is positioned a locking wedge cooperating with an angle transmission, the method is characterized in that it consists of positioning the mounting element in the opening, positioning the locking wedge facing an internal cavity positioned in the opening, pressing the angle transmission between the locking wedge and the slide until the locking wedge comes into contact with the internal cavity.

According to a particular arrangement, it comprises a step of abutting an abutment face, positioned on the mounting element, on a lower face of the internal cavity, thus the mounting element is blocked along its axis X.

Other advantages could also appear to a person skilled in the art upon reading the examples below, illustrated by the appended drawings, given by way of examples:

DETAILED DESCRIPTION

Figure 1:
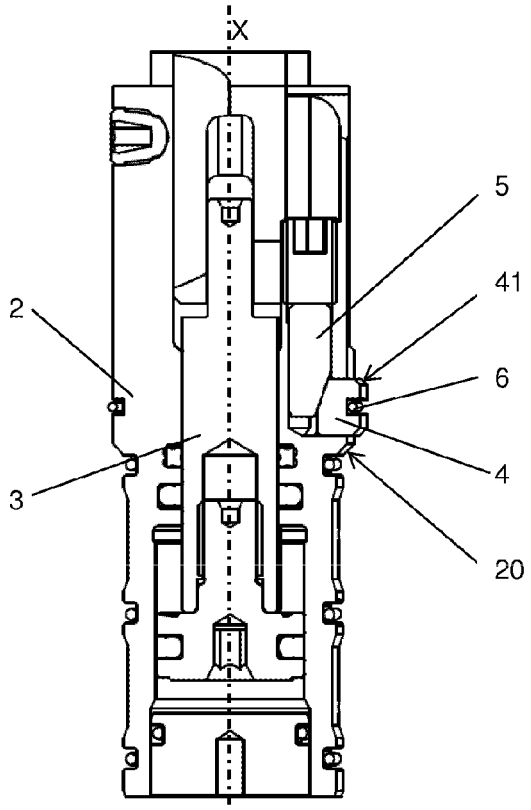
FIG. 1 is a section view of the clamping ring and of the piston according to a first embodiment of the invention.
Figure 2:
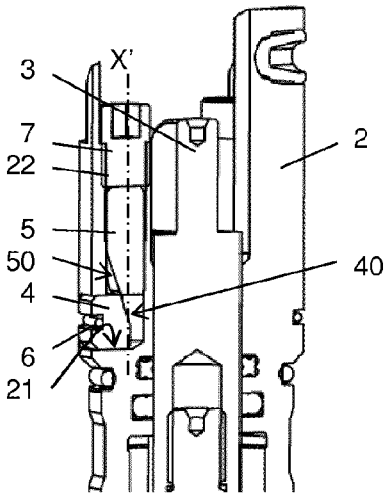
FIG. 2 is a sectional detail of the locking joint in the unlocked position.
Figure 3:
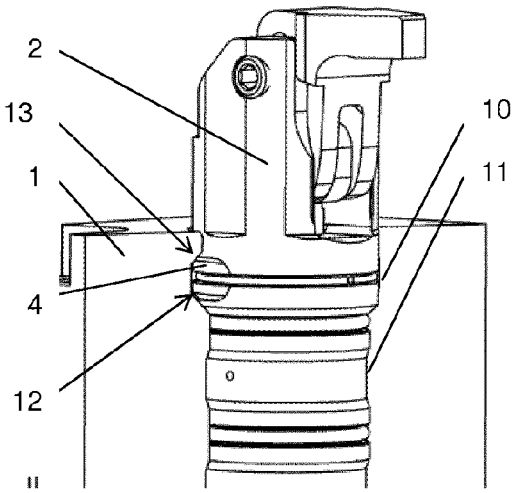
FIG. 3 is a perspective view of the locking joint of FIG. 2.
Figure 4:
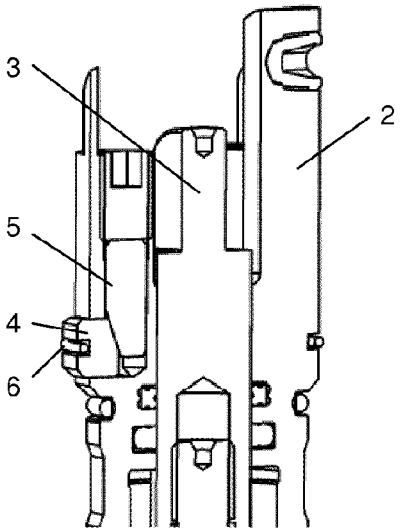
FIG. 4 is a section view of the locking joint in the locked position.
Figure 5:
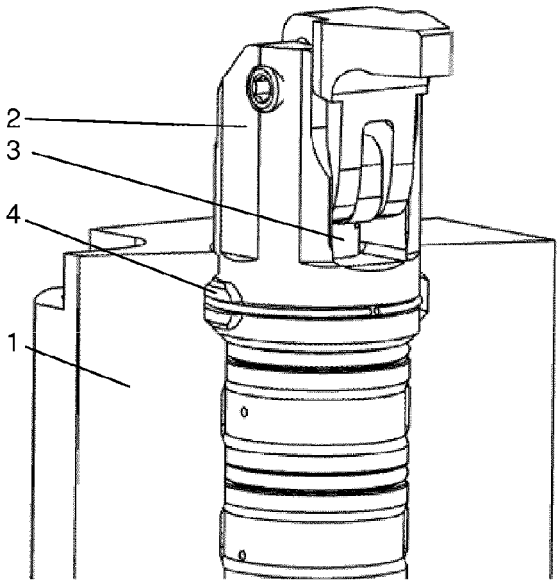
FIG. 5 is a perspective view of the locking joint of FIG. 4.

In the description hereafter it will be considered that the upward direction corresponds to the upper part of the figures.

The clamping device comprises a support 1 in which are positioned a mounting element 2 such as a clamping ring and a cylinder 3. The cylinder 3 is intended to impart a movement along an axis X to the ring 2. The axis X is positioned vertically on the figures and for the description that follows.

The mounting device 2 has a slide 21 with a radial axis, i.e. perpendicular to the axis X. A locking wedge 4 is positioned in the slide 21. The wedge 4 is surrounded by an elastic snap ring 6 which allows it to be returned to the retracted position in the slide 21 and which is housed in a circular groove of the ring, which also extends over the locking wedge 4. The slide 21 communicates with at least one chimney 22 (two here, diametrically opposed) with an axis X' parallel to the axis X in which is placed an angle transmission 5.

The locking wedge 4 has a beveled face 40 placed on the inner side of the slide 21. This beveled face 40 cooperates with a beveled face 50 of the transmission 5. The beveled faces 40 and 50 preferably form an angle of 15 to 30° with respect to the axis X.

The support 1 has a circular X-axis opening 11 which has an inner circular groove 10 intended to receive the wedge 4. This inner groove 10 has a profile with two inclined circular faces: an upper face 13 and a lower face 12. The wedge 4 has an inclined upper clamping cone 41 capable of resting against the upper face 13 of the inner groove 10. The mounting element 2 has a clamping cone 20 intended to rest against the lower face 12 of the inner groove 10.

We will now describe the method that allows the mounting element 2 to be clamped in the support 1. The mounting element 2 is placed on the piston 3 in the circular opening 11 of the support 1 by a vertical movement along the axis X until the clamping cone 20 comes into contact with the lower face 12 of the inner groove 10. The mounting element 2 is angularly positioned on the support 1; once the desired angular position is obtained the angle transmission 5 is given a downward movement along the axis X' in order to push the locking wedge 4 toward the bottom of the inner groove 10 until it comes into abutment. This movement is accomplished here by screwing a screw 7 on the chimney 22 of the mounting element 2; while descending, the screw 7 pushes the transmission 5 downward and, through its beveled face 50 it pushes the wedge 4.

To unlock the mounting element 2, a reverse procedure is followed, but after the transmission 5 has returned upward, the clamping cone 4 is pushed back toward the bottom of the slide 21 by the snap ring 6.

Figure 6:
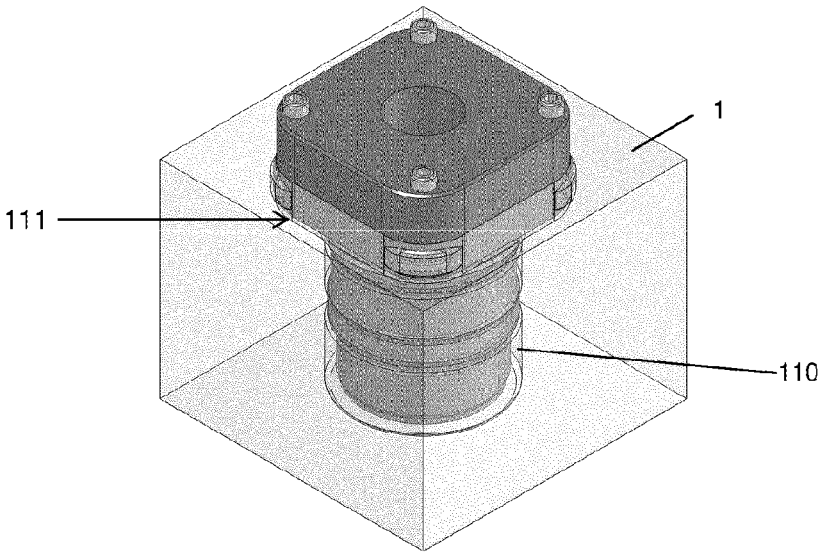
FIG. 6 is a perspective view of a second embodiment.
Figure 7:
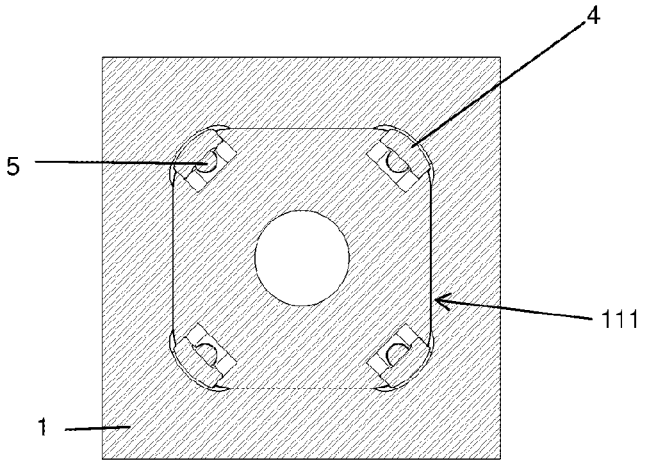
FIG. 7 is a bottom view of FIG. 6.

FIGS. 6 and 7 show a second embodiment where the opening 11 has a circular portion 110 placed at the bottom of the support, and a square portion 111 at the top. In this case, the mounting element 2 has an upper portion 23 with a square profile and a lower portion 24 with a circular profile. The upper portion 23 has a locking cone 4 at each corner of the square upper portion 23.

Figure 8:
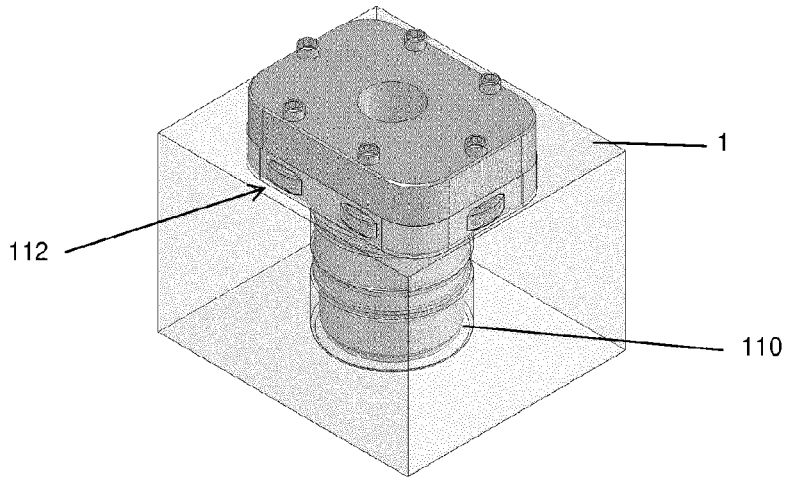
FIG. 8 is a perspective view of a third embodiment.
Figure 9:
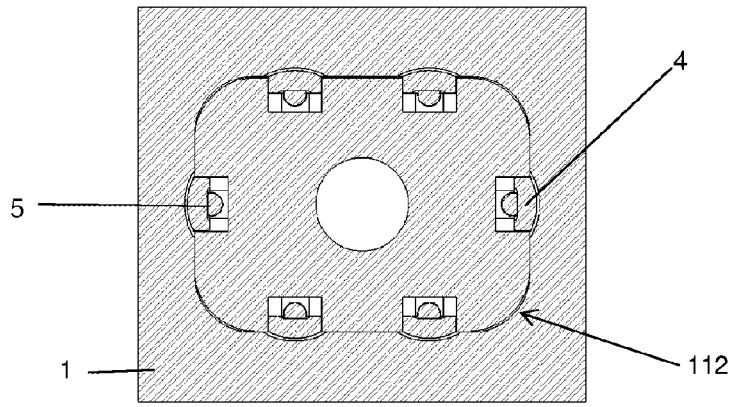
FIG. 9 is a bottom view of FIG. 8.

In FIGS. 8 and 9, showing a third embodiment of the invention, the opening 11 has a circular portion 110 at the bottom and a rectangular portion 112 on top. The mounting element 2 has an upper portion 25 with a rectangular profile. The locking cones 4 are distributed over each side of the rectangle, therefore either in the middle of a side if there is only one locking cone 4, or equidistant if they are two in number.

Figure 10:
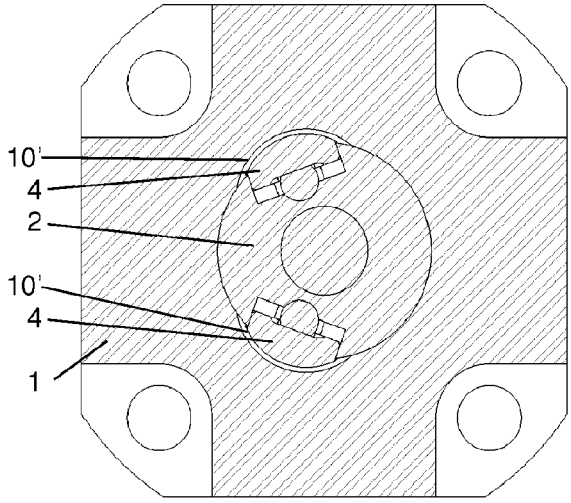
FIG. 10 is a perspective view of a fourth embodiment of the invention.
Figure 11:
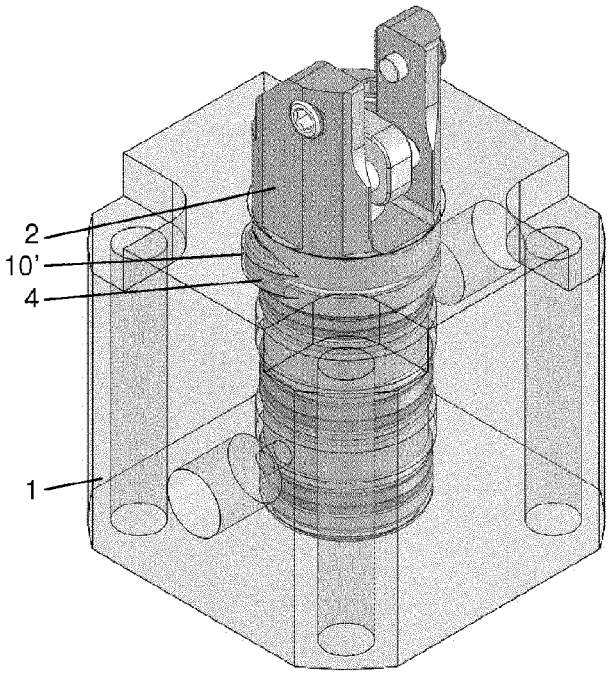
FIG. 11 is a section view of the system of FIG. 10.

In a fourth embodiment, as shown in FIGS. 10 and 11, the inner groove is replaced by notches 10' in which the locking wedges 4, of a correspondingly adapted shape, are housed. Thus, the orientation of the mounting element 2 is predetermined by the position of the notches 10'.

The invention is not limited to the embodiments which have just been described by way of examples. Thus, the beveled faces 40 and 50 can have a different angle, but the sum of their respective angles must be equal to the angle between the sliding axes, the value of the angle allowing more or less movement of the locking wedge 4. The clamping cone can be replaced by a simple shoulder.

The invention claimed is:

1. A clamping system comprising:

an X-axis mounting element that extends along an X-axis, wherein the X-axis mounting element comprises a slide that defines an interior space into which a locking wedge, cooperating with an angle transmission that moves parallel to the X-axis within the interior space of the slide, is positioned, wherein movement of the angle transmission parallel to the X-axis within the interior space causes the locking wedge, in its entirety, to solely translationally move in a direction perpendicular to and away from the X-axis; and a support having an X-axis opening through which the X-axis extends and in which the X-axis mounting element is placed, wherein the support comprises an internal cavity positioned in the X-axis opening and the locking wedge, when moved in the direction perpendicular to and away from the X-axis, is attached to the support by being inserted within the internal cavity in a male/female manner so as to form a male-female attachment with the support;

wherein the X-axis mounting element comprises an abutment face cooperating with a lower face of the internal cavity; and wherein the locking wedge comprises an inclined upper clamping cone that rests against an inclined upper face of the internal cavity to clamp a ring on the abutment face.

2. The system according to claim 1, wherein the X-axis opening is a blind hole.

3. The system according to claim 1, wherein the X-axis mounting element is mounted pivotally around the axis X.

4. The system according to claim 1, wherein the mounting element is blocked in pivoting around an axis X.

5. The system according to claim 1, wherein the angle transmission forms an angle between 5 and 45° with respect to the X-axis.

6. The system according to claim 1, wherein the abutment face has the shape of a cone.

7. The system according to claim 1, wherein the X-axis mounting element is a clamping ring.

8. The system according claim 1, wherein the X-axis opening is circular.

9. The system according to claim 1, wherein the internal cavity is a circular internal groove.

10. The system according to claim 1, wherein the internal cavity is formed by a plurality of peripheral notches.

11. The system according to claim 1 further comprising an elastic element housed in a circular groove and resting on the locking wedge, the elastic element tending to clamp the locking wedge against the angle transmission.

12. The system according to claim 11, wherein the elastic element is a snap ring.

* * * * *